United States Patent [19]

Silverman

[11] Patent Number: 4,957,298

[45] Date of Patent: Sep. 18, 1990

[54] PERMUTATION GROUP GAMES

[76] Inventor: Jack Silverman, 302 W. 87th St., New York, N.Y. 10024

[21] Appl. No.: 327,076

[22] Filed: Mar. 22, 1989

[51] Int. Cl.[5] ..... A63F 3/00

[52] U.S. Cl. ..... 273/240; 273/272; 380/59; 283/73

[58] Field of Search ..... 273/240, 272; 380/59; 283/73

[56] References Cited

U.S. PATENT DOCUMENTS 1,318,366 10/1919 Farquhar ..... 380/59

4,509,758 4/1985 Cole ..... 273/240

*Primary Examiner*—Benjamin Layno

*Attorney, Agent, or Firm*—Pennie & Edmonds

[57] ABSTRACT

A game is described involving operations on a permutation group (X,*) where X is a set of symbols, illustratively the alphabet, and * is a two argument operation on the symbols of said set, said group having closure, associativity, an identity element and an inverse for each element of the set. A series of plaintext symbols of the set X is encoded by replacing each plaintext symbol with a symbol pair comprising two of the three symbols x, y, z in the relation x*y=z and where x, y, and z are each elements of the set X and one of x, y and z is the plaintext symbol to be encoded. The encoded symbol pairs are then decoded to recover the series of plaintext symbols.

7 Claims, 4 Drawing Sheets

| | A | B | C | D | E | F | G | H | I | J | K | L | M | N | O | P | Q | R | S | T | U | V | W | X | Y | Z |
|---|---|---|---|---|---|---|---|---|---|---|---|---|---|---|---|---|---|---|---|---|---|---|---|---|---|---|
| A | a | b | c | d | e | f | g | h | i | j | k | l | m | n | o | p | q | r | s | t | u | v | w | x | y | s |
| B | b | a | e | f | c | d | h | g | k | l | i | j | t | u | v | w | i | x | y | m | n | o | p | r | s | y |
| C | c | d | a | b | f | e | m | n | o | p | r | s | g | h | i | j | r | k | l | u | t | x | y | v | w | l |
| D | d | c | f | e | a | b | n | m | r | s | o | p | u | t | x | y | o | v | w | g | h | i | j | k | l | w |
| E | e | f | b | a | d | c | t | u | v | w | x | y | h | g | k | l | x | i | j | n | m | r | s | o | p | j |
| F | f | e | d | c | b | a | u | t | x | y | v | w | n | m | r | s | v | o | p | h | g | k | l | i | j | p |
| G | g | h | i | j | k | l | a | b | c | d | e | f | o | p | m | n | e | s | r | v | w | t | u | y | x | r |
| H | h | g | k | l | i | j | b | a | e | f | c | d | v | w | t | u | c | y | x | o | p | m | n | s | r | x |
| I | i | j | g | h | l | k | o | p | m | n | s | r | a | b | c | d | s | e | f | w | v | y | x | t | u | f |
| J | j | i | l | k | g | h | p | o | s | r | m | n | w | v | y | x | m | t | u | a | b | c | d | e | f | u |
| K | k | l | h | g | j | i | v | w | t | u | y | x | b | a | e | f | y | c | d | p | o | s | r | m | n | d |
| L | l | k | j | i | h | g | w | v | y | x | t | u | p | o | s | r | t | m | n | b | a | e | f | c | d | n |
| M | m | n | o | p | r | s | c | d | a | b | f | e | i | j | g | h | f | l | k | x | y | u | t | w | v | k |
| N | n | m | r | s | o | p | d | c | f | e | a | b | x | y | u | t | a | w | v | i | j | g | h | l | k | v |
| O | o | p | m | n | s | r | i | j | g | h | l | k | c | d | a | b | l | f | e | y | x | w | v | u | t | e |
| P | p | o | s | r | m | n | j | i | l | k | g | h | y | x | w | v | g | u | t | c | d | a | b | f | e | t |
| Q | k | l | h | g | j | i | v | w | t | u | y | x | b | a | e | f | y | c | d | p | o | o | r | m | n | d |
| R | r | s | n | m | p | o | x | y | u | t | w | v | d | c | f | e | w | a | b | j | i | l | k | g | h | b |
| S | s | r | p | o | n | m | y | x | w | v | u | t | j | i | l | k | u | g | h | d | c | f | e | a | b | h |
| T | t | u | v | w | x | y | e | f | b | a | d | c | k | l | h | g | d | j | i | r | s | n | m | p | o | i |
| U | u | t | x | y | v | w | f | e | d | c | b | a | r | s | n | m | b | p | o | k | l | h | g | j | i | c |
| V | v | w | t | u | y | x | k | l | h | g | j | i | e | f | b | a | j | d | c | s | r | p | o | n | m | c |
| W | w | v | y | x | t | u | l | k | j | i | h | g | s | r | p | o | h | n | m | e | f | b | a | d | c | m |
| X | x | y | u | t | w | v | r | s | n | m | p | o | f | e | d | c | p | b | a | l | k | j | i | h | g | a |
| Y | y | x | w | v | u | t | s | r | p | o | n | m | l | k | j | i | n | h | g | f | e | d | c | b | a | g |
| Z | s | r | p | o | n | m | y | x | w | v | u | t | j | i | l | k | u | g | h | d | c | f | e | a | b | h |

10

FIG. 1

| | A | B | C | D | E | F | G | H | I | J | K | L | M | N | O | P | Q | R | S | T | U | V | W | X | Y | Z |
|---|---|---|---|---|---|---|---|---|---|---|---|---|---|---|---|---|---|---|---|---|---|---|---|---|---|---|
| A | a | b | c | d | e | f | g | h | i | j | k | l | m | n | o | p | q | r | s | t | u | v | w | x | y | s |
| B | b | a | e | f | c | d | h | g | k | l | i | j | t | u | v | w | i | x | y | m | n | o | p | r | s | y |
| C | c | d | a | b | f | e | m | n | o | p | r | s | g | h | i | j | r | k | l | u | t | x | y | v | w | l |
| D | d | c | f | e | a | b | n | m | r | s | o | p | u | t | x | y | o | v | w | g | h | i | j | k | l | w |
| E | e | f | b | a | d | c | t | u | v | w | x | y | h | g | k | l | x | i | j | n | m | r | s | o | p | j |
| F | f | e | d | c | b | a | u | t | x | y | v | w | n | m | r | s | v | o | p | h | g | k | l | i | j | p |
| G | g | h | i | j | k | l | a | b | c | d | e | f | o | p | m | n | e | s | r | v | w | t | u | y | x | r |
| H | h | g | k | l | i | j | b | a | e | f | c | d | v | w | t | u | c | y | x | o | p | m | n | s | r | x |
| I | i | j | g | h | l | k | o | p | m | n | s | r | a | b | c | d | s | e | f | w | v | y | x | t | u | f |
| J | j | i | l | k | g | h | p | o | s | r | m | n | w | v | y | x | m | t | u | a | b | c | d | e | f | u |
| K | k | l | h | g | j | i | v | w | t | u | y | x | b | a | e | f | y | c | d | p | o | s | r | m | n | d |
| L | l | k | j | i | h | g | w | v | y | x | t | u | p | o | s | r | t | m | n | b | a | e | f | c | d | n |
| M | m | n | o | p | r | s | c | d | a | b | f | e | i | j | g | h | f | l | k | x | y | u | t | w | v | k |
| N | n | m | r | s | o | p | d | c | f | e | a | b | x | y | u | t | a | w | v | i | j | g | h | l | k | v |
| O | o | p | m | n | s | r | i | j | g | h | l | k | c | d | a | b | l | f | e | y | x | w | v | u | t | e |
| P | p | o | s | r | m | n | j | i | l | k | g | h | y | x | w | v | g | u | t | c | d | a | b | f | e | t |
| Q | k | l | h | g | j | i | v | w | t | u | y | x | b | a | e | f | y | c | d | p | o | o | r | m | n | d |
| R | r | s | n | m | p | o | x | y | u | t | w | v | d | c | f | e | w | a | b | j | i | l | k | g | h | b |
| S | s | r | p | o | n | m | y | x | w | v | u | t | j | i | l | k | u | g | h | d | c | f | e | a | b | h |
| T | t | u | v | w | x | y | e | f | b | a | d | c | k | l | h | g | d | j | i | r | s | n | m | p | o | i |
| U | u | t | x | y | v | w | f | e | d | c | b | a | r | s | n | m | b | p | o | k | l | h | g | j | i | c |
| V | v | w | t | u | y | x | k | l | h | g | j | i | e | f | b | a | j | d | c | s | r | p | o | n | m | c |
| W | w | v | y | x | t | u | l | k | j | i | h | g | s | r | p | o | h | n | m | e | f | b | a | d | c | m |
| X | x | y | u | t | w | v | r | s | n | m | p | o | f | e | d | c | p | b | a | l | k | j | i | h | g | a |
| Y | y | x | w | v | u | t | s | r | p | o | n | m | l | k | j | i | n | h | g | f | e | d | c | b | a | g |
| Z | s | r | p | o | n | m | y | x | w | v | u | t | j | i | l | k | u | g | h | d | c | f | e | a | b | h |

10

THE CUBE

PERMUTATION GROUP GAMES

BACKGROUND OF THE INVENTION

The present invention relates to permutation groups and games utilizing such groups.

If one defines a set of elements X and an operation * that assigns to each pair of elements a and b of X an element c of X, then the pair G=(X,*) is called a group if it has the properties of closure, associativity, identity and inverse. For the pair (X,*) to have closure, the operation * must assign to each pair of elements of X another element of X. Thus, if a, b are elements of X, then *(a,b) (which may also be written a*b) must also be an element of X. For the pair (X,*) to have associativity, then a*(b*c)=(a*b)*c where a, b, c are elements of X. For the pair (X,*) to have an identity, there must be an element I in X such that I*x=x*I=x for each element x of the set X. For the pair (X,*) to have an inverse, then each element x in the set X must have an element $x^{-1}$ in the set X for which $x*x^{-1}=x^{-1}*x=I$ where I is the identity element.

An example of a group is the pair formed by the positive real numbers and the operation of multiplication. Multiplication of two positive real numbers has closure since it always yields a positive real number. Multiplication is associative; the identity element is 1; and the inverse of any positive real number a under the operation of multiplication is 1/a. Another example of a group is the pair formed by the real numbers and the operation of addition.

A permutation of a set of elements is an ordering of the set of elements. For example, if the set of elements consists of the four numbers, 1,2,3 and 4, one such ordering is 1234 and another such ordering is 2143. The number of different orderings of a set of elements is equal to n! where n is the number of different elements in the set. For example, if the set of elements consists of the four numbers 1,2,3,4, then there are 4!=4 x 3 x 2 x 1=24 different ways of arranging these numbers. These 24 different ways are set forth in Table I.

TABLE I

| | | | |
|---|---|---|---|
| 1 2 3 4 | 2 1 3 4 | 3 1 2 4 | 4 1 2 3 |
| 1 2 4 3 | 2 1 4 3 | 3 1 4 2 | 4 1 3 2 |
| 1 3 2 4 | 2 3 1 4 | 3 2 1 4 | 4 2 1 3 |
| 1 3 4 2 | 2 3 4 1 | 3 2 4 1 | 4 2 3 1 |
| 1 4 2 3 | 2 4 1 3 | 3 4 1 2 | 4 3 1 2 |
| 1 4 3 2 | 2 4 3 1 | 3 4 2 1 | 4 3 2 1 |

As is demonstrated below, operations can be defined on the collection of all permutations of a set of elements such that the pair formed by the collection and the operation(s) satisfies the properties of closure, associatively, identity and inverse. Such pairs are called permutation groups. For further information about permutation groups, see Fred S. Roberts, *Applied Combinatorics*, (Prentice-Hall, 1984), especially §7.2.

In the teaching of the rules of permutation groups to beginning students and others having trouble mastering the concepts and principles of same, it is important for teachers to present the material in an effective manner. Traditional methods of teaching such as memorization of modular systems and derivation of equations has in many instances been very difficult for both the student and the teacher. It is therefore desirable to have an apparatus and a method for teaching and learning the rules of permutation groups which is less tedious than the traditional methods and which provides for the student a rewarding experience.

Equally important are the avid game players who are always looking for new and challenging games which may be played for sheer intellectual stimulation and pleasure. It is therefore desirable to have an apparatus and a method for playing a game which has varying degrees of difficulty and which provides exciting entertainment to the avid game player.

SUMMARY OF THE INVENTION

This invention provides a novel approach to teaching and learning of the properties of permutation groups.

It is an object of the present invention to provide teachers with an interesting approach to teaching the properties of permutation groups to students.

It is another object of the present invention to provide students with a challenging and enjoyable approach to learning the properties of permutation groups.

Another object of the present invention is to provide students with an apparatus and method of playing a game which will facilitate the learning process involved in mastering the rules of permutation groups.

A further object of the present invention is to provide an apparatus and method of playing a game which provides measurable success for both the student and the teacher of permutation group rules.

Still a further object of the present invention is to provide an apparatus and method of playing a game for entertainment and pleasure purposes.

Yet another object of the present invention is to provide an apparatus and method of playing a game which is easy to learn, yet provides sufficient complexity to appeal to a broad range of persons.

It is an object of the present invention to provide a game wherein the method of play may be altered slightly to provide additional complexity as the players acquire expertise.

In accordance with the invention a permutation group (X,*) is defined where X is a set of symbols and * is a two argument operation on the symbols of said set, said group having closure, associativity, an identity element and an inverse for each element of the set. A series of plaintext symbols of the set X is then encoded by replacing each plaintext symbol with a symbol pair comprising two of the three symbols x, y, z in the relation x*y=z where x, y, and z are each elements of the set X and one of x, y and z is the plaintext symbol to be encoded. The set of symbol pairs is then decoded by use of the same operation * and the results of this decoding are recorded on a recording means. Several different decoding techniques are available. Once the player has recorded these results on the recording means, the results can be analyzed and a solution obtained.

Where there is only one player, the player's object is to decode the encoded phrase within a predetermined time constraint imposed upon the player. The time constraint will vary with the degree of difficulty of the encoded phrase. Where two or more people play, the players compete to be the first player to successfully decode the encoded phrase and the game is won by the first player to successfully decode the encoded phrase.

BRIEF DESCRIPTION OF THE DRAWINGS

These and other objects, features and advantages of the present invention will become apparent from the following detailed description of the invention when considered in conjunction with the accompanying drawings.

FIG. 1 is a function lookup table for use in a first embodiment of the invention;

DETAILED DESCRIPTION OF THE INVENTION

FIG. 1 depicts a function lookup table 10 which defines a function which we will call "star" and write as *. Table 10 has twenty-six rows R identified by the letters A–Z and twenty-six columns C identified by the letters A–Z such that there are twenty-six letters in each row and twenty-six letters in each column. However, the row and column for Q are identical to the row and column for K and the row and column for Z are identical to the row and column for S. Further, examination will reveal that aside from "Q" and "Z" each one of the letters of the alphabet is found in each row and in each column, but that the order of the letters is different in each row and in each column.

The construction of table 10 is described below. Suffice for now to note that any pair of letters $R_i$, $C_j$ which identify one of the rows R and one of the columns C will also specify a letter entry $E_{ij}$ at the intersection of that row and column. Thus the letter pair H, G also identifies the letter B that is entered in the table at the intersection of the H row and the G column. Further, the function * has an identity element A since $A*x=x*A=x$ for any element x in the alphabet. Since the arguments set forth in the column and row headings and the results set forth in the table are all members of the alphabet, there is closure. It can also be shown that each element x has an inverse $x^{-1}$ such that $x*x^{-1}=x^{-1}*x=A$ and that * is associative. Hence lookup table 10 depicts a group.

In accordance with the invention, a plaintext word or phrase is encoded secretly by one of the players by using table 10 to identify for each letter of the plaintext to be encoded a triplet $R_i$, $C_j$, $E_{ij}$ containing the plaintext letter. Two of the three letters of that triplet are then substituted for the plaintext letter while preserving the order of the letters. Thus, the ordered letter pairs $R_i$, $C_j$ or $R_i$, $E_{ij}$ or $C_j$, $E_{ij}$ are substituted for the plaintext letter. The resulting encoded text has the form $((X_1, Y_1), (X_2, Y_2), \ldots (X_i, Y_i) \ldots (X_n, Y_n))$ where each pair $(X_i, Y_i)$ is a pair of ordered letters selected by the encoder from a triplet $R_i$, $C_j$, $E_{ij}$ to represent a plaintext letter.

Figure 2:
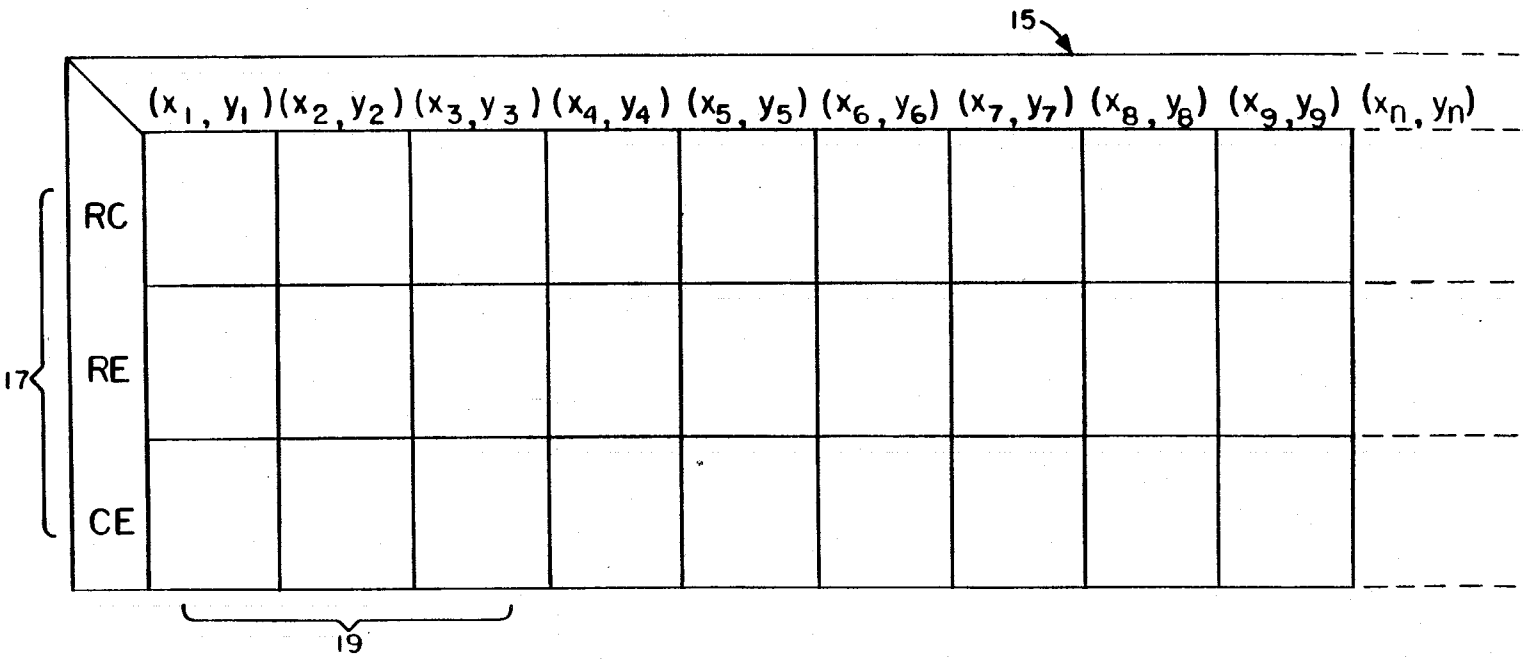
FIG. 2 is a top view of a recording means for use in the first embodiment of the invention.

The players then take turns attempting to decode the encoded text. This is most easily done using a recording means 15 shown in FIG. 2. Means 15 comprises three rows 17 and at least as many columns 19 as there are letter pairs in the encoded text. Each row represents one of the three possible ordered letter pairs that can be derived from a triplet of the form R, C, E and accordingly have been labelled RC, RE, and CE, respectively. Each column is used to decode one of the letter pairs in the encoded text. Advantageously, each letter pair is written across the top of the column as shown in FIG. 2.

To decode a letter pair, the player first assumes that the letter pair represents the row and column identifiers $R_i$, $C_j$ of the triplet and determines from the lookup table of FIG. 1 the identity of the letter $E_{ij}$ at the intersection of row $R_i$ and column $C_j$ of the table. This letter $E_{ij}$ is written in the RC row under the letter pair in the recording means. Next, the player assumes the letter pair represents the row and entry $R_i$, $E_{ij}$ of the triplet and determines from the lookup table the column or columns in which the entry $E_{ij}$ appears in row $R_i$ of the table. The column identifier, or identifiers, $C_j$ is then written in the RE row under the letter pair. Finally, the player assumes the letter pair represents the column and entry $C_j$, $E_{ij}$ of the triplet. In this case, he determines from the lookup table the row or rows in which the entry $E_{ij}$ appears in column $C_j$ and writes the row identifier, or identifiers, $R_i$ in the CE row under the letter pair.

This process is repeated for each letter pair in the encoded text. When he believes he has a solution, he informs the other players; and the proposed solution is compared with the original plaintext to determine if it is correct.

For example, the word "JACK" may be encoded by use of table 10 to produce the four letter pairs (p,g), (t,t), (n,h), (m,b). These letter pairs are then decoded using the lookup table to find the missing elements of the triplet assuming each letter pair corresponds to the elements ($R_i$, $C_j$), ($R_i$, $E_{ij}$) and ($C_j$, $E_{ij}$) of the triplet. For example, the letter pair (p,g) produces the values RC=J, RE=K and CE=T. In like fashion each of the other letter pairs of the phrase (p,g), (t,t), (n,h), (m,b) are evaluated to produce the values set forth in Table II:

TABLE II

| | $(X_1, Y_1)$ | $(X_2, Y_2)$ | $(X_3, Y_3)$ | $(X_4, Y_4)$ |
|---|---|---|---|---|
| RC | J | R | C | N |
| RE | K | A | W | J |
| CE | T | A | C | K |

Having recorded these results on the recording means 15, each column 19 of recording means 15 is examined by the player and a letter is chosen from each column 19 so that a word is formed when the chosen letters are placed together in the same order as the columns 19 from which they were chosen. Upon inspection of the recording means the player will realize that the words "Jack" and "Tack" may be formed from the entries in Table II. He then guesses one of these words and this is compared with the plaintext word that was originally encoded.

To generalize the foregoing description, a group (X, *) is defined where X is a set of symbols and * is a two argument operation on the symbols of said set, said group having closure, associativity, an identity element and an inverse for each element of the set. A series of plaintext symbols of the set X is then encoded by replacing each plaintext symbol with a symbol pair comprising two of the three symbols x, y, z in the relation $x*y=z$ where x, y, and z are each elements of the set X and one of x, y and z is the plaintext symbol to be encoded. The set of symbol pairs is then decoded by use of the same operation * to recover the plaintext symbols.

Different techniques can be used to construct lookup table 10. Advantageously, lookup table 10 is constructed by first assigning to each one of the twenty-four letters of the alphabet except Q and Z a unique four digit number consisting of the numbers 1, 2, 3, and 4. The letters Q and Z are given the same numbers as K and S, respectively. The collection of these twenty-four four digit numbers will be recognized as all the permutations of the four numbers 1, 2, 3 and 4. We will call this collection ALPHABET. Illustratively, the assignments of letters to four digit numbers are those set forth in Table III; but anyone of the 24! possible assignments of these twenty-four different four digit numbers could be used.

TABLE III

| | | | |
|---|---|---|---|
| A = 1234 | G = 2134 | M = 3124 | T = 4123 |
| B = 1243 | H = 2143 | N = 3142 | U = 4132 |
| C = 1324 | I = 2314 | O = 3214 | V = 4213 |
| D = 1342 | J = 2341 | P = 3241 | X = 4231 |
| E = 1423 | K = 2413 | R = 3412 | X = 4312 |
| F = 1432 | L = 2431 | S = 3421 | Y = 4321 |

Next, a two argument operation is defined which we will call "star" and represent by the symbol "*". In accordance with the invention, the operation * is defined so that it and ALPHABET constitute a permutation group. In particular, the operation * is defined so that the pair (ALPHABET, *) is closed, associative, has an identity element and has an inverse for each member of ALPHABET.

In particular, the operation * is defined in terms of an algorithm comprising the following steps wherein the identity element is defined to be A=1234 so that A*x=x*A=x for every element of ALPHABET:

1. associate each of the symbols of the first argument with its corresponding symbol (i.e. the symbol located in the same position in the element) in the identity element;

2. rearrange the order of the symbols of the identity element and the symbols of the first argument that are associated therewith so that the symbols of the identity element are now in the order of the symbols of the second argument;

3. at this point the order of the symbols of the first argument that are associated with the rearranged symbols of the identity element is the result.

An equivalent definition of this algorithm is:

rearrange the symbols of the first argument so that each of the i symbols of the first argument where i is the initial position of the symbol in the argument, is in the same position in the rearranged symbols of the first argument as that symbol of the second argument which is also the ith symbol of the identity element.

For example, consider * (H,M), which may also be written H*M. From Table III, H=2143 and M=3124. Associating the symbols of H with the symbols in the same positions in the identity element A produces:

H: 2 1 4 3
A: 1 2 3 4.

If we rearrange the order of the symbols in this association so that the symbols of the identity element A are now in the order of the second argument M while the associations established in the first step remain the same, we have

? = 4 2 1 3
M = 3 1 2 4.

Thus each of the symbols of the identity element and its associated symbol from the first argument has now been rewritten in the order of the symbols of the second argument M. We now consult Table III to determine the letter assigned to 4213, which we find is V. Thus, performance of the operation * on the arguments H and M has yielded the value V.

In lookup table 10, the letter identified by the first argument represents the row of lookup table 10 associated with that letter; and the letter identified by the second argument represents the column of table 10 associated with that letter. Inspection of lookup table 10 of FIG. 1 will reveal that V is the entry at the intersection of the H row and M column of the lookup table 10.

Alternatively, the four ordered symbols 2,1,4,3 assigned to the first argument H are rearranged in the order in which the symbols 1,2,3,4, respectively, appear in the second argument M. Thus, 2, which is the first symbol of the first argument is placed in the second position since the first symbol 1 of the identity element appears in the second position in the second argument; 1, which is the second symbol of the first argument is placed in the third position since the second symbol 2 of the identity element appears in the third position in the second argument: 3 is placed in the fourth position and 4 is placed in the first position. The result is 4213 which is the same as the result obtained by the first algorithm.

In like fashion, using either algorithm the values for the entire lookup table 10 can be calculated. Such calculation of the lookup table will confirm that A is the identity, that each element has an inverse, that the operation * is associative and that there is closure. Hence, the pair (ALPHABET, *) is a permutation group.

Numerous variations can be made in the above game. The difficulty of the game can be increased by increasing the length of the phrase to be encoded. In addition the order of the pair of letters used to encode a plaintext letter can be ignored. Thus, if R=N, C=M and E=X, the coder can use any of six pairs (N,M), (N,X), (M,X), (M,N), (X,N), (X,M) to encode a plaintext letter that is a member of the triplet N,M,X. This gives the decoder as many as six letters to choose from which greatly complicates the task of forming sensible words and guessing the correct solution.

As a variation, a set of pre-coded phrases could be included in the game package. This allows for solitaire play as well as permitting a race between two or more players. The phrases could be encoded on cards and different sets of cards might be used, each set containing phrases related to a different topic such as geography, history, music, current events, etc.

Figure 3:
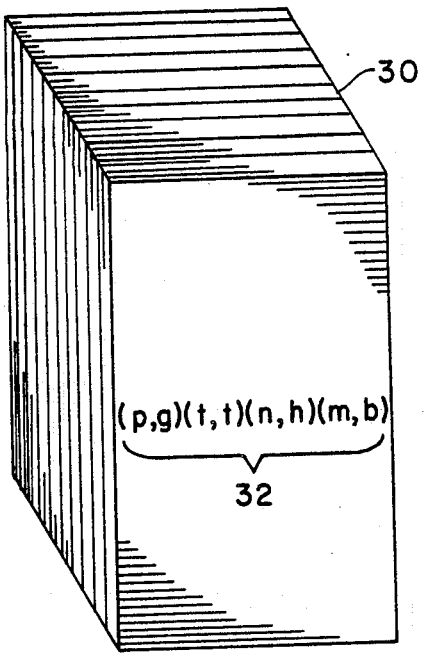
FIG. 3 is a front view of a playing card for use in the present invention.
Figure 4:
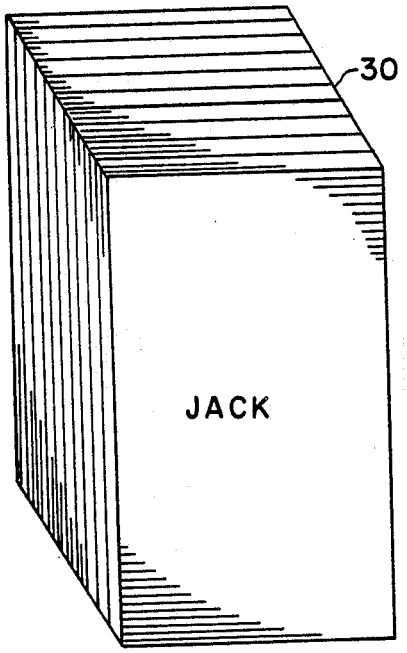
FIG. 4 is a back view of a playing card for use in the present invention.

Thus, one embodiment of the present invention, the invention comprises lookup table 10 and recording means 15 of FIGS. 1 and 2 and a deck of cards 30 as shown in FIGS. 3 and 4, each card having a back face 31 and a front face 33. On the back face of each card a set of letter pairs 32 is provided which encodes a plaintext word or phrase 34 that is set forth on the front face of the card. The deck of cards 30 is placed back-faces-up so that a player (or a group of players) cannot view the front faces 33 of the cards. The player then selects a card from the deck of cards 30 and reads from upon the back face 31 a first encoded phrase 32 which is then decoded by the player using lookup table 10 and recording means 15.

For example, upon inspection of the letter pairs 32 shown in FIG. 3, and entry in the recording means of the decoded letters which are set forth in Table II, the player will realize that the words Jack and Tack may be formed. The player then lists these words. When one player believes that all possible words have been formed from the entries on the recording means 15, that player turns the card front-face-up so that the plaintext word or phrase 34 is revealed only to that player. The player checks his list of words to see if one of those words is the word revealed on the card. If one of the words listed by the player is the code word, the player has successfully decoded the first encoded phrase 32 and that player wins that round of play by displaying his list and the card with the code word on it to the other players, if there are any other players. If the player finds that he did not correctly decode the set of letter pairs 32, then he loses his turn or is otherwise penalized; and the other players, if any, may continue playing until a player successfully decodes the set of letter pairs 32. Where only one player is playing the game, this player attempts to successfully decode the set of letter pairs under a predetermined time constraint.

The function of lookup table 10 can be implemented in different ways. For example, the set of encoded letter pairs may be decoded simply by using the value table as shown in Table III, two sets of four cards, the cards of each set bearing one of the numbers 1, 2, 3 and 4 and a set of transformations which may be represented as follows:

$$RC = * (X_1, Y_1): \frac{X_1}{A} => \frac{E}{Y_1}; \quad (1)$$

$$RE = \# (X_1, Y_1): \frac{A}{X_1} => \frac{C}{Y_1}; \quad (2)$$

$$CE = @ (X_1, Y_1): \frac{Y_1}{X_1} => \frac{R}{A}. \quad (3)$$

The first of these transformations is the operation * used in constructing lookup table 10. Each of the symbols of the first argument $X_1$ is associated with the corresponding symbol in the identity element A. This establishes a relationship represented by $X_1/A$ in transformation (1). Next, the order of symbols in the identity element is rearranged so that the symbols of the identity element are now in the order of the symbols of the second argument $Y_1$. In making such rearrangement, each of the symbols of the first argument continues to be associated with the same symbol of the identity element with which it was originally associated. As a result, the symbols of the first argument are also rearranged into the order of the symbols which yields the result. This rearrangement is represented in transformation (1) by $E/Y_1$ where E is the result. E will be found to be the entry at the intersection of the row R and column C identified by the arguments $X_1$ and $Y_1$. Thus, transformation (1) is used to decode each of the letter pairs 32 to produce the result E which is entered in the RC row of recording means 15 of FIG. 2 in the column under that letter pair.

Alternatively, as indicated above in the discussion of the construction of lookup table 10, transformation (1) can also be implemented directly by rearranging each of the i symbols of the first argument $X_1$ in the order in which the ith symbol of the identity element appears in the second argument.

Transformations (2) and (3) are similar but define two other operations # and @. In transformation (2), the symbols of the first argument $X_1$ are again associated with the symbols of the identity element A but in this case it is the order of the symbols of the first argument that is rearranged so that they are in the order of the second argument $Y_1$. Each of the symbols of the identity element continues to be associated with the same symbol of the first argument with which it was originally associated; and as a result the symbols of the identity element are rearranged to form the result C. C is the identity of the column in which the entry E as specified by the second argument is found in the row R identified by the first argument. In decoding the letter pairs 32, the result C is the answer entered in the RE row of recording means 15.

In transformation (3), the symbols of the second argument $Y_1$ are associated with the symbols of the first argument $X_1$ as represented by $Y_1/X_1$. Next the order of the symbols of the first argument is rearranged into the order of the identity element A. Each of the symbols of the second argument continues to be associated with the same symbol of the first argument with which it was originally associated; and as a result the symbols of the second argument are rearranged to form the result R. R is the identity of the row in which the entry E identified by the second argument $Y_1$ is found in the column C identified by the first argument $X_1$. In decoding the letter pairs 32, the result R is the answer entered in the CE row of recording mans 15.

For example, for the letter pair (p,g), the player may find the value E by using transformation (1) where $X_1$=p and $Y_1$=g. The player lays out one set of number cards in the order 1, 2, 3, 4, looks up the value of p in Table III and lays out the second set of number cards in the order of the value of p on top of the first set of cards. In particular, since the value of p is 3 2 4 1 from Table III, the second set of number cards is placed on the first set of number cards as shown in Table IV:

TABLE IV

| | | | | | | | |
|---|---|---|---|---|---|---|---|
| 3 | 2 | 4 | 1 | — | — | — | — |
| | | | | — | — | — | — |
| 1 | 2 | 3 | 4 | — | — | — | — |
| | | | | — | — | — | — |

Next, the player rearranges the lower set of cards in the order of the second argument $Y_1$ which in the example is g which as a value of 2134. In this rearrangement, the upper set of cards are rearranged along with the lower set of cards to produce the final result shown in Table V.

TABLE V

| | | | | | | | |
|---|---|---|---|---|---|---|---|
| 3 | 2 | 4 | 1 | 2 | 3 | 4 | 1 |
| 1 | 2 | 3 | 4 | 2 | 1 | 3 | 4 |

From Table III the value 2 3 4 1 is seen to correspond to the letter J. This alphabet letter is then recorded in the RC row in the appropriate column of recording means 15 of FIG. 2.

In the same fashion, the values C and R may be determined for the letter pair (p,g), using transformations (2) and (3). These transformations are applied to each pair of letters ($X_n$, $Y_n$), and the results of these transformations are recorded in appropriate RE and CE rows of recording means 15 of FIG. 2. From these results a plaintext word or phrase may be selected as in the first embodiment of the present invention.

Alternatively, transformation (1) can be implemented directly by arranging one set of cards in the order of the first argument, laying out the second set of cards in the order of the second argument and then placing the first card of the first set on top of the 1 card in the second set, the second card of the first set on top of the 2 card in the second set and so on. The resulting order of the cards of the first set will be the answer.

Figure 5:
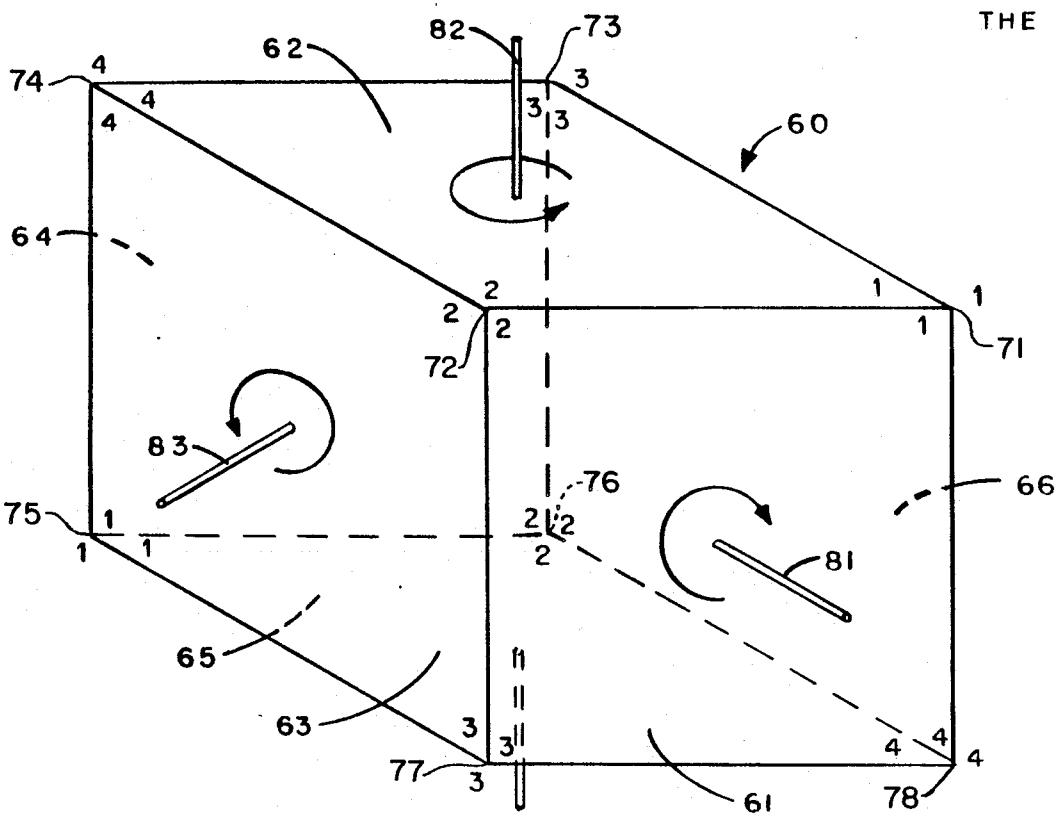
FIG. 5 is a perspective view of a cube useful in practicing another embodiment of the invention.

In still another embodiment of the present invention, the operation * is implemented using a value table as shown in Table VI and a parallelepiped such as cube 60 shown in FIG. 5.

Cube 60 comprises six faces 61–66, each face having four corners. There are eight vertices 71–78, at each of which three corners of three different faces meet. The four corners of each face are numbered 1, 2, 3 and 4 respectively, and the corners of the different faces which meet to form a vertex are assigned the same number. Thus, there are two vertices 71, 75 at which the corners are all numbered 1, and these vertices are opposite each other. Similarly, there are two vertices 72, 76 at which the corners are all numbered 2, and these vertices are opposite each other, etc.

For this numbering pattern, it can readily be seen that the sequence of numbers as one proceeds in the same direction around the periphery of each of the six faces is different. Moreover, since each of the numbers 1, 2, 3, 4 is found on each face, twenty-four different numbers can be represented by specifying a face of cube 60 and the starting point for the numbers on that face. These numbers are of course, the twenty-four permutations of the numbers 1, 2, 3, 4 set forth in Table I.

In accordance with the invention, cube 60 implements lookup table 10 and transformation (1) by performing a series of rotations about three orthogonal axes 81, 82, 83 through the centers of its three major faces. As a result of these rotations any face of the cube can be rotated into the position of face 61 shown in FIG. 5; and that face can be rotated so that any one of its four corners is in the upper right hand corner of the face in the position of face 61. Since each of the corners of each face is numbered, this makes it possible to specify a set of rotations that will move each of the twenty-four numbers of Table III to the position of the numbers 1, 2, 3, 4 shown on face 61 in FIG. 5. This specification of rotations can be shown to have the same properties as that of transformation (1). The position of the cube in which the face 61 bearing the numbers 1, 2, 3, 4 is oriented as shown in FIG. 5 functions as an identity element.

To describe these rotations precisely, we must develop an appropriate nomenclature. First, we will read the numbers on a face commencing in the upper right hand corner and proceeding counterclockwise. Thus each of the twenty-four different four digit numbers uniquely specifies a face of the cube and which digit is in the upper right hand corner. Next, we call a 90 degree clockwise rotation about axis 81 a "rotation" which is represented by R; we call a 90 degree counterclockwise rotation about axis 82 a "flip" which is represented by F; and a 90 degree counterclockwise rotation about axis 83 a "turn" which is representation by T. Rotations of 180 degrees or 270 degrees are represented by the numbers 2 or 3, respectively, in front of the symbol identifying the axis of rotation. For example, 2T represents a turn of 180 degrees and F3R represents a flip of 90 degrees and a rotation of 270 degrees.

It can be shown that each one of the twenty-four different orientations of the faces of cube 60 can be rotated to the position of face 61 shown in FIG. 5 by the rotations specified in Table VI.

TABLE VI

| | |
|---|---|
| A = | 1 2 3 4: no motion |
| B = | 1 2 4 3: T2R |
| C = | 1 3 2 4: F2R |
| D = | 1 3 4 2: F3T |
| E = | 1 4 2 3: RT |
| F = | 1 4 3 2: 2TR |
| G = | 2 1 3 4: 2RT |
| H = | 2 1 4 3: 2T |
| I = | 2 3 1 4: 3F3R or TRTR |
| J = | 2 3 4 1: R |
| K = | 2 4 1 3: F |
| L = | 2 4 3 1: T3R |
| M = | 3 1 2 4: FT |
| N = | 3 1 4 2: 3F |
| O = | 3 1 4 2: 3F |
| P = | 3 2 4 1: F3R |
| R = | 3 4 1 2: 2R |
| S = | 3 4 2 1: 3T |
| T = | 4 1 2 3: 3R |
| U = | 4 1 3 2: FR |
| V = | 4 2 1 3: 3TR |
| W = | 4 2 3 1: 2RF |
| X = | 4 3 1 2: T |
| Y = | 4 3 2 1: 2F |

Further, since there are twenty-four different four digit numbers we can associate these with twenty-four letters of the alphabet and can make the same associations as in Table III. Advantageously, Q is assigned the same value as K and Z is assigned the same value as S.

Finally, it can be shown that the cube implements lookup table 10. For example, to find the value G*W, the cube is first positioned so that the face representing "G" is positioned in the position of face 61 with the vertex number 2 in the upper right hand corner. This is done by moving the cube from the position shown in FIG. 5 through a 180 degree rotation followed by a 90 degree turn as specified opposite the G identification in Table VI. Next, the cube is moved through the manipulations specified opposite the W entry in Table VI, namely it is rotated 180 degrees and flipped 90 degrees. As a result, the cube comes to be oriented so that the face bearing the numbers 4132, reading counterclockwise from the upper right hand corner, is located in the position of face 61. From Table VI, 4132 is assigned to U Which is the same result obtained from lookup table 10 for the operation G*W. In like fashion any operation of * on the arguments set forth in Table VI will produce the same results as lookup table 10.

Several other games can be played using lookup table 10, Table III or cube 60 and Table VI. In one such game, the operations *, #, or @ are performed successively on a whole series of arguments instead of on only two as in the previous embodiments; and the point of the game is to be the first to complete the correct evaluation of the whole series of values.

For example, the arguments V*I*C*T*0*R*Y may be evaluated as follows using the function lookup table 10 of FIG. 1, cube 60 and Table VI or the values of Table III and the transformation (1):

V*I*C*T*O*R*Y
H*C*T*O*R*Y

-continued

K*T*O*R*Y
P*O*R*Y
W*R*Y
N*Y
K

Since the operation * is associative, evaluation of these arguments from right to left or with other groupings of the values will also yield the result K. Similar evaluations may be made with the operations # and @; and further complexity may be introduced into the game by using more than one operation in the series to be evaluated as in V*I#C@T*0*R#Y. However, since the operation # and @ are not associative, either parentheses or a specific order of operation such as left to right will have to be established and consistently followed to produce a unique answer. As will be apparent, failure to observe these rules will teach a quick lesson on the meaning of associativity.

As a variation on this, a player can attempt to determine an unknown argument in a series of arguments and operations that are elements of a group using the result and the remaining arguments and operations. This solution makes use of the identity element of the group and the inverse of an argument.

As indicated above, for a given operation, the inverse of an argument is that value for which execution of the operation on the two values produces the identity element. Thus $(x_i)*(x_i)^{-1}=A$. Where the player uses lookup table 10, the inverse of a value under the operation * is found by examining the row $R_i$ identified by that value, locating in that row the value A and reading the column value $C_i$ in which that value A appears. The column value is the inverse of the row value since $R_i*C_i=A$. Alternatively, the inverse of a value can be determined by examining the column $C_i$ identified by the value to locate the value A and then reading the row value $R_i$ in which the value A appears.

Where the player uses the value table as shown in Table III and two sets of four cards to determine the inverses, transformation (1) is used, but in this case the second argument is unknown and the result of the transformation is known to be the identity element A. This may be represented:

$$*(x_i, x_i^{-1}): \frac{x_i}{A} => \frac{A}{x_i^{-1}}.$$

or:

$$*(x_i, x_i^{-1}): \frac{A}{x_i} => \frac{x_i^{-1}}{A}.$$

The first set of cards is laid out 1, 2, 3, 4 in the order of the identity element A. The second set of cards is laid out on top of the first set in the order of the argument $x_i$ so that each of the symbols of argument $x_i$ is associated with a corresponding symbol (i.e. the symbol located in the same position in the element) in the identity element A. Thus, the two sets of four cards establish the relationship represented by $x_i/A$. Next, the order of symbols in the second set of cards representing the argument $x_i$ is rearranged so that the symbols of argument $x_i$ are now in the order of the symbols of the identity element. In making such rearrangement, each of the symbols of the first set of cards representing the identity element continues to be associated with the same symbol of the second set of cards with which it was originally associated. As a result, the symbols of the first set of cards are also rearranged into the order of the symbols which yield the inverse of argument $x_i$, namely $x_i^{-1}$.

For example to find the inverse of J, the player lays out one set of number cards in the natural order 1 2 3 4, looks up the value of J in Table III and lays out the second set of number cards in the order of the value J on top of the first set of cards. In particular, since the value of J is 2 3 4 1 from Table III, the second set of number cards is placed over the first set of number cards as shown in Table VII.

TABLE VII

| | |
|---|---|
| 2 3 4 1 | — — — — |
| | — — — — |
| | — — — — |
| 1 2 3 4 | — — — — |

Next, the player rearranges the upper set of cards into the order of the identity element, 1 2 3 4. In this rearrangement, the lower set of cards are rearranged along with the upper set of cards to produce the final result shown in Table VIII.

TABLE VIII

| | |
|---|---|
| 2 3 4 1 | 1 2 3 4 |
| 1 2 3 4 | 4 1 2 3 |

From Table III, the value 4 1 2 3 is seen to correspond to the letter T. Thus, the letter T is the inverse of J.

A table of inverses can also be derived for cube 60. In each case the inverse of any value is that combination of flips, rotations and turns which restores the cube to the identity element (i.e., the position of face 61 shown in FIG. 5).

Transformations (2) and (3) are specific applications of inverses to the equation R*C=E. In particular, the unknown result C in transformation (2) can be written in terms of the known arguments R, E by applying the inverse, $R^{-1}$, to both sides of the equation R*C=E. Since $R^{-1}*R=A$ and since A*C=C, this yields:

$$\begin{aligned} R*C &= E \\ R^{-1}*R*C &= R^{-1}*E \\ A*C &= R^{-1}*E \\ C &= R^{-1}*E. \end{aligned}$$

Likewise, the unknown result R in transformation (3) can be written in terms of the known arguments C,E by applying the inverse $C^{-1}$ to both sides of the equation R*C=E as follows:

$$\begin{aligned} R*C &= E \\ R*C*C^{-1} &= E*C^{-1} \\ R*A &= E*C^{-1} \\ R &= E*C^{-1}. \end{aligned}$$

In this embodiment of the invention, the expression to be solved has the general form $X_1$ op . . . $X_i$ op?op $Y_1$ op . . . $Y_i$=Z where $X_i$ and $Y_i$ are known arguments and Z is the result, all being elements of the group, op represents an operation such as * which meets the requirements of a group and ? represents the unknown argument. The unknown argument is isolated on one side of the equation by successive applications to both sides of the equation of operations involving inverses and the elimination of identity elements to yield the solution $?=X_i^{-1}$ op . . . $X_1^{-1}$ op Z op $Y_i^{-1}$ op . . . $Y_i^{-1}$.

Thus, the expression V*I*C*?*0*R*Y=K may be evaluated as follows:

$$
\begin{aligned}
V*I*C*?*O*R*Y &= K \\
V^{-1}*V*I*C*?*O*R*Y*Y^{-1} &= V^{-1}*K*Y^{-1} \\
A*I*C*?*O*R*A &= V^{-1}*K*Y^{-1} \\
I*C*?*O*R &= V^{-1}*K*Y^{-1} \\
I^{-1}*I*C*?*O*R*R^{-1} &= I^{-1}*V^{-1}*K*Y^{-1}*R^{-1} \\
A*C*?*O*A &= I^{-1}*V^{-1}*K*Y^{-1}*R^{-1} \\
C*?*O &= I^{-1}*V^{-1}*K*Y^{-1}*R^{-1} \\
C^{-1}*C*?*O*O^{-1} &= C^{-1}*I^{-1}*V^{-1}*K*Y^{-1}*R^{-1}*O^{-1} \\
A*?*A &= C^{-1}*I^{-1}*V^{-1}*K*Y^{-1}*R^{-1}*O^{-1} \\
? &= C^{-1}*I^{-1}*V^{-1}*K*Y^{-1}*R^{-1}*O^{-1}
\end{aligned}
$$

Having isolated the unknown on one side of the equation, the player then evaluates the expression on the other side of the equation by using either the lookup table 10, or cube 60 and Table VI or the value table shown in Table III and two sets of four cards. In general this requires the player to determine the inverse of several arguments using any of the techniques available and then evaluate these inverses in light of the operations performed on them. Where the operations performed are all the operation *, successive applications of lookup table 10 may be used to obtain the solution (?). Alternatively, cube 60 and Table VI or Table III and the two sets of four cards can also be used to obtain the solution.

For example, where the unknown argument is found in the equation J*A*(?)*C=K, the law of inverses may be applied in order to express the equation in terms of a solution $(?)=A^{31\ 1}*J^{-1}*K*C^{-1}$. Then, the inverses $A^{-1}$, $J^{-1}$ and $C^{-1}$ may be determined using lookup table 10, to be A, T and C, respectively. Thus (?)=A*T*K*C which can be determined from table 10 to be (?)=F. The same solution can be obtained by use of Table III and manipulation of the two sets of four cards each.

Numerous other variations may be implemented in the practice of the invention. While the invention has been described in terms of a set of twenty-four elements each of which is a different one of the twenty-four permutations of the numbers 1,2,3,4, it will be appreciated that the invention may be practiced on sets of other sizes as well.

One such set is the set HEX of six elements, each of which is a different one of the six permutations of the numbers 1,2,3. This set may be defined as set forth in Table IX.

TABLE IX

| |
|---|
| A = 1 2 3 |
| B = 1 3 2 |
| C = 2 1 3 |
| D = 2 3 1 |
| E = 3 1 2 |
| F = 3 2 1 |

Again A is the identity element and the same procedures used to define lookup table 10 can be used to define an operation ⊕ on the set HEX which is closed, associative, has an identity and has an inverse for each element.

The operation ⊕ can also be defined in terms of manipulations of a physical object, in this case a triangle instead of a parallelepiped. For example, the numerical values set forth in Table IX can be mapped onto an equilateral triangle which is oriented so that one side is horizontal by mapping the first numerical value to the angle opposite the horizontal side, the second numerical value to the angle on the left of the horizontal side and the third numerical value to the angle on the right of the horizontal side.

As a result, the following associations are established as set forth in Table X.

TABLE X

| | |
|---|---|
| A = 1 2 3: | 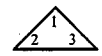  |
| B = 1 3 2: | 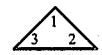  |
| C = 2 1 3: | 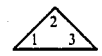  |
| D = 2 3 1: | 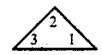  |
| E = 3 1 2: | 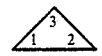  |
| F = 3 2 1: | 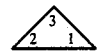  |

Further inspection of Table X will reveal that each of the orientations specified for the values B through F can be obtained by rotating the triangle representing the value A about an axis through the center of the triangle and/or by flipping the triangle about an axis in the plane of the triangle that bisects the angle of the triangle labelled 1. Thus, the values of D and E are achieved by rotating the triangle representative of the value of A 120 degrees clockwise and counterclockwise, respectively. The values for F and C are achieved by combining the operations for D and E, respectively, with a flip. The value for B is achieved by a flip.

As in the case where multiple manipulations of the cube of FIG. 5 can be performed so as to execute the operation * once or several times, so too multiple manipulations of the triangle depicted in Table X can be performed so as to execute the operation ⊕ once or several times.

While the examples discussed thus far involve sets of relatively small numbers of elements, it will be appreciated by those skilled in the art that the concepts disclosed herein can also be applied to sets having any number of elements. Advantageously, computers may also be used to implement the techniques herein disclosed.

What is claimed:

1. A game comprising the steps of:

defining a permutation group (X,*) where X is a set of symbols and * is a two argument operation on the symbols of said set, said group having closure, associativity, an identity element and an inverse for each element of the set;

encoding a series of plaintext symbols of the set X by replacing each plaintext symbol with a symbol pair comprising two of the three symbols x, y, z in the relation x*y=z and where x, y, and z are each elements of the set X, and one of x, y and z is the plaintext symbol to be encoded; and decoding the encoded symbol pairs to recover the series of plaintext symbols.

2. The method of claim 1 wherein the permutation group is defined by a lookup table for the operation * and the step of decoding the encoded symbol pairs comprises the steps of:

for each encoded symbol pair (a,b) determining from the lookup table each possible third symbol c where two of the three symbols a, b, c are arguments of the operation * and the remaining symbol is the result of such operation on the other two symbols, and selecting from the third symbols c determined for each symbol pair a best estimate of the plaintext symbols.

3. The method of claim 1 wherein the permutation group is defined by a lookup table which associates each symbol of set X with a multidigit set of symbols and by a mapping which simulates the operation *.

4. The method of claim 1 wherein each symbol of set X including the identity element is associated with a multidigit set of symbols and the operation * is implemented on first and second arguments by an algorithm which:

associates each digit of the first argument with a digit in the same position in the identity element;

reorders the digits in the identity element so that they are in the order of the digits in the second argument and reorders the digits of the first argument in the same fashion so that each digit continues to be associated with the digit of the identity element with which it was associated; and provides as a result the reordered digits of the first argument.

5. The method of claim 1 wherein each symbol of set X including the identity element is associated with a multidigit set of symbols and the operation * is implemented on first and second arguments by rearranging the digits of the first argument so that each of the i digits of the first argument where i is the initial position of the digit in the argument is in the same position in the rearranged digits of the first argument as that digit of the second argument which is also the ith digit of the identity element.

6. The method of claim 1 wherein each symbol of set X including the identity element is associated with a multidigit set of symbols and the operation * is implemented on first and second arguments by rearranging the symbols of the first argument in the order in which the symbols of the identity element appear in the second argument.

7. The method of claim 1 wherein each symbol of set X including the identity element is associated with a four digit set of symbols and the operation * is implemented on first and second arguments by a lookup table and a cube, the cube being marked so as to represent the twenty-four permutations of four digits and the lookup table specifying for each symbol of set X one of the twenty-four permutations of four digits and a series of manipulations of the cube so as to move a representation of that permutation on the cube to a reference position.

* * * * *